United States Patent [19]

Lowe et al.

[11] 4,064,665

[45] Dec. 27, 1977

[54] ICE ANCHORING METHOD AND DEVICE

[75] Inventors: Greg E. Lowe, Ogden, Utah; Michael R. Lowe, Eldorado Springs, Colo.

[73] Assignee: Lowe Alpine Systems, Inc., Lafayette, Colo.

[21] Appl. No.: 708,957

[22] Filed: July 26, 1976

[51] Int. Cl.[2] ..... E02D 5/74

[52] U.S. Cl. ..... 52/155; 85/11; 175/18

[58] Field of Search ..... 52/155; 175/18, 404, 175/405, 58; 299/94; 248/16.1, 16.2, 16.3; 30/164.5, 164.6, 164.7, 164.8; 125/41–43; 145/30 R, 29 R; 85/11, 68; 7/8.1

[56] References Cited

U.S. PATENT DOCUMENTS

| | | | |
|---|---|---|---|
| 286,599 | 10/1883 | Fitzgerald | 175/18 |
| 1,882,906 | 10/1932 | Renfer et al. | 299/94 X |
| 2,321,101 | 6/1943 | Openshaw | 85/14 X |
| 2,955,805 | 10/1960 | Jones, Jr. et al. | 175/18 |
| 3,208,538 | 9/1965 | Pitcher | 175/405 X |
| 3,735,434 | 5/1973 | Penberthy | 125/43 X |

*Primary Examiner*—Ernest R. Purser
*Assistant Examiner*—Richard E. Favreau
*Attorney, Agent, or Firm*—O'Rourke & Harris

[57] ABSTRACT

An ice anchoring device, and particularly an ice hammer, having a relatively thin walled, partially open or fully closed channel, with opposed interior walls at at least a portion of the channel, and, preferably, parallel outer walls, which, when impacted upon ice, fractures the ice internally of the channel while producing a basically undisturbed void in the ice sufficient to accommodate the anchoring device. Preferably the channel is in the form of an initially closed tube having an inwardly sloping bevel from a cutting edge defined at the end of the tube, and an opening in the tube spaced back from the end of the tube to facilitate removal of fractured ice. The method is practiced by inserting the tube into ice with force and localizing the destructive forces inwardly to the volume within the channel thereby avoiding weakening and fracturing of the remaining exterior portion of the ice in which the device is anchored.

15 Claims, 15 Drawing Figures

ICE ANCHORING METHOD AND DEVICE

BACKGROUND OF THE INVENTION

1. Field of the Invention

The present invention relates generally to ice anchoring devices, and more particularly to ice anchoring devices such as ice axes, ice daggers, pitons, etc., which are implanted in ice to assist climbers.

2. Description of the Prior Art

One of the more demanding mountain climbing exercises is the climbing of the glaciers and frozen waterfalls. Climbers conventionally use anchoring devices, and particularly ice hammers, to aid in scaling such icy terrain. However, these previous anchoring devices have essentially been modifications of anchoring devices readily adapted to climbing on rock, or constituted, in essence, of enlarged ice picks. In rock climbing, it is conventional to employ tappered anchoring devices which wedge into cracks and crannies. However, when working on ice, the cracks and crannies are created by the anchoring device itself. Because of the brittleness and planes of cleavage in ice, driving of an anchoring device into the ice utilizing an expanding wedge concept has, while operable, seriously compromised the strength of the ice after securing the anchoring device. As with the conventional ice pick, many of the previous anchoring devices were more suited for cleaving the ice into sections, though of course this does not always happen as a result of the mass of ice involved, than in providing secure purchase for a climber by preserving the inherent strength of the ice.

Tubular members, being quite common, have been used as anchoring devices. However, it appears that most the edge of such members has been formed by grinding an external bevel. This of course results in a spreading wedge action when the member is driven. Those with an internal bevel have been troubled with impacted ice in the bore as a result of the reduced diameter of the bore relative to the larger diameter of the edge of the bevel.

SUMMARY OF THE INVENTION

The present invention, which provides a heretofore unavailable improvement over previous ice anchoring devices and methods comprises an elongated member having substantially parallel exterior walls and an internal channel therethrough with at least in part opposing inner walls. The device, when used to provide an anchorage in ice, creates an opening in the ice by, in effect, fracturing or crushing the ice inwardly between the opposed walls of the channel without fracturing or substantially weakening the supporting ice exterior of the elongated member. A relief opening or counterbore is preferably provided to allow the fractured ice to promptly expand.

Accordingly, it is an object of the present invention to provide a new and improved method and device for providing anchorage in ice without substantially displacing or weakening the supporting ice in which the anchorage is set.

Another object of the present invention is to provide a new and improved method and device for affording anchorage in ice in which the device is preferably self cleaning to facilitate removal of fractured ice within the device.

Yet another object of the present invention is to provide a new and improved method and device for affording anchorage in ice in which the device may be readily hand placed and removed.

Still another object of the present invention is to provide a new and improved method and device for affording anchorage in ice in which the device is in the form of a novel ice hammer.

Yet still another object of the present invention is to provide a new and improved method and device for affording anchorage in ice in which the device is provided with a toothed edge to selectively enhance the interface bonding between the device and ice in which it is secured.

These and other objects and features of the present invention will become apparent from the following description.

DETAILED DESCRIPTION OF THE INVENTION

Figure 1:
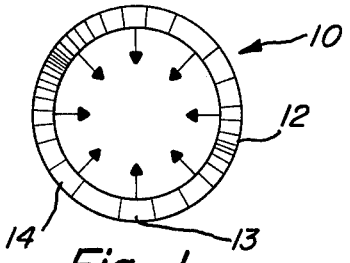
FIG. 1 is a front view of an anchoring device in accordance with the instant invention.

Turning now to the drawings wherein like components are designated by like reference numerals throughout the various figures, an ice anchoring device is illustrated at FIG. 1 and is generally designated by the reference numeral 10. As will be described in more detail hereinafter, anchoring device 10 is formed of an elongated member having substantially parallel outer wall and a channel defined therethrough with opposed walls through at least a portion thereof. Preferably, anchoring device 10 is in the form of tube 12, as illustrated in FIGS. 1, 2, and 3, having cutting edge 13 adjacent the outer surface of tube 12 with inward bevel 14 sloping from the cutting edge 13 to the interior of tube 12.

Figure 3:
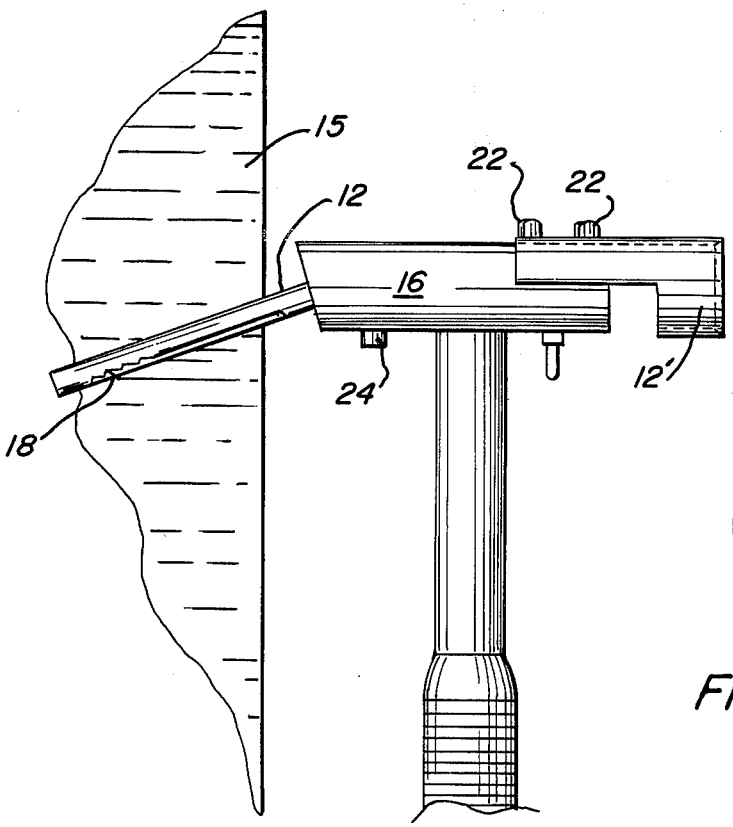
FIG. 3 is a view of the ice hammer illustrated in FIG. 2 embedded in supporting material shown in cross section.

In operation, anchoring device 10 is impacted on the ice 15, as illustrated in FIG. 3, with the cutting edge 13 generating inward forces as illustrated by the arrows in FIG. 1. As a result of the weakness of ice as a result of planes of cleavage, bevel 14 generates inward directed forces in tube 12, as illustrated by the arrows in FIG. 1, thereby fracturing the ice internally of tube 12. However, external of tube 12, the ice is relatively undisturbed thereby presenting excellent purchase for anchoring device 10.

Figure 2:
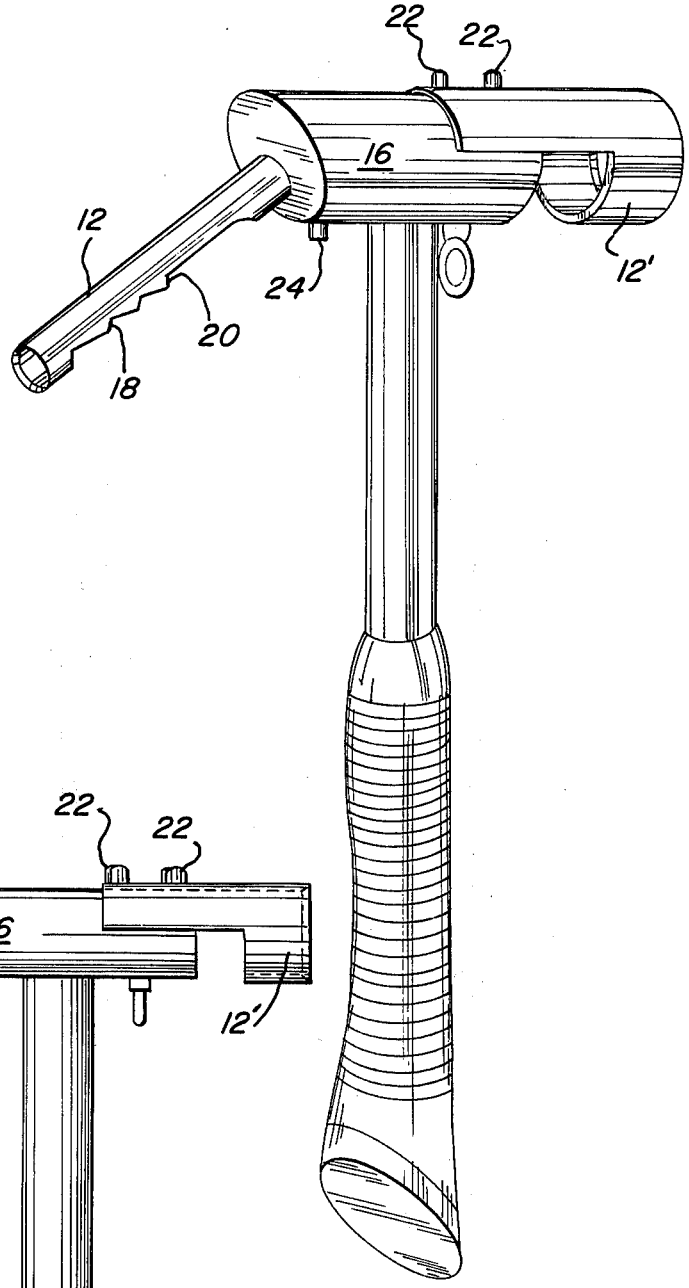
FIG. 2 is a perspective view of an anchoring device in accordance with the instant invention in the particular embodiment of an ice hammer.

A particularly desirable embodiment of the invention is illustrated at FIG. 2 in which two anchoring devices 10 are provided on a common support, i.e., ice hammer 16. Smaller tube 12 protrudes at an angle from ice hammer 16 and is provided with notched anchoring teeth 18 which, as shown in FIG. 3, provides for enhanced anchoring of tube 12 in ice 15. Also, teeth 18 form a part of opening 20 through which fractured ice may be passed to avoid back pressure in tube 12 as ice anchoring device 10 is impacted. Larger tube 12' of ice hammer 16 is illustrated as being mounted in a removable configuration utilizing securing means 22 to releasably secure large tube 12' to ice hammer 16. Larger tube 12' is particularly adapted for use in, for instance, frozen snow and softer ice in which a greater cross sectional area can be removed conveniently to provide a greater anchoring volume to compensate for the lesser strength of the softer material.

As shown in FIG. 3, smaller tube 12 depends from ice hammer 16 at an angle. Accordingly, when smaller tube 12 is impacted upon ice 15, and penetration on the order of about 2 inches is gained, ice hammer 16 provides a secure, level purchase to the user and teeth 18 further insures that tube 12 will not inadvertently release from ice 15.

Other features of ice hammer 15 includes the use of the set screw 24 to secure tube 12 in ice hammer 16 thereby permitting convenient replacement of smaller tube 12.

Figure 4:
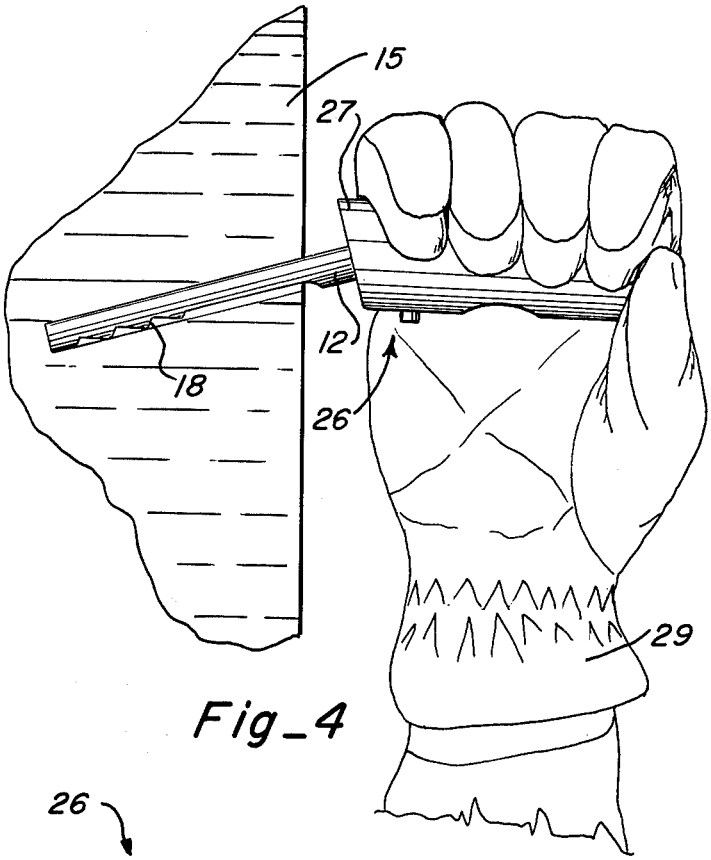
FIG. 4 is a view similar to FIG. 3 in which the ice anchor is in the form of an ice dagger.

As shown in FIGS. 4 through 7, ice dagger 26, which can be the removable head portion of ice hammer 16, is useable in a manner analogous to that described with reference to FIG. 3. Again, by angling tube 12 downward relative to handle 27 of ice dagger 26, handle 27 presents a convenient level support which may be, as illustrated in FIG. 4, grasped by a climber's hand 29 or, alternatively, used as a foot support in an obvious manner.

Figure 5:
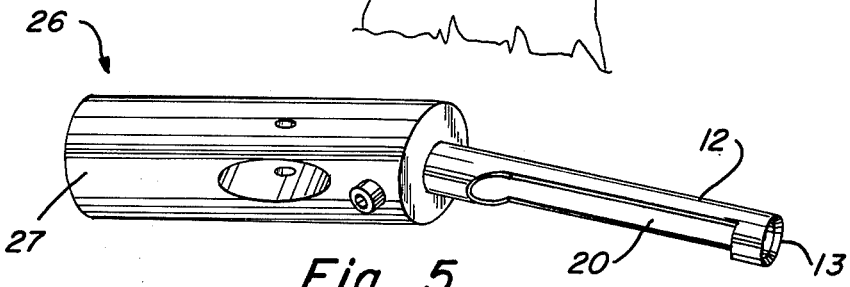
FIG. 5 is a perspective view of an embodiment of the ice dagger of FIG. 4.
Figure 6:
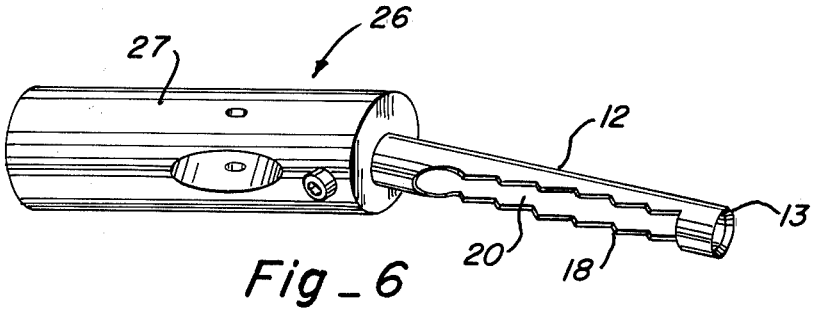
FIG. 6 is a perspective view of another embodiment of the ice dagger of FIG. 4.
Figure 7:
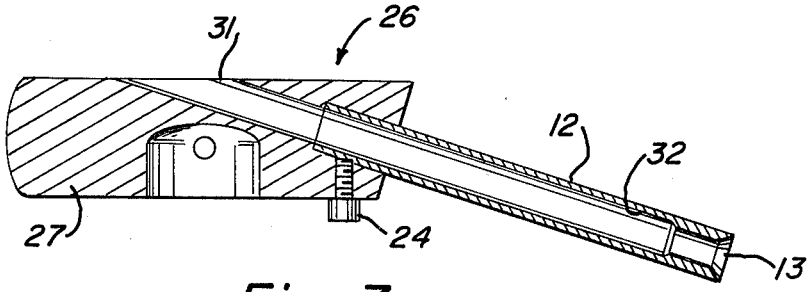
FIG. 7 is a sectional view of yet another embodiment of the ice dagger of FIG. 4.

Other variations on the preferred embodiment of the invention are illustrated in FIGS. 5 through 7. As shown in FIG. 5, ice dagger 26 includes tube 12 having defined therein an opening substantially immediately rearward of the cutting edge 13 of tube 12. The embodiment of FIG. 6 is substantially identical to that of FIG. 5, except that teeth 18 are also provided in opening 20 to further secure tube 12 when placed in ice.

Another functionally similar but structurally different embodiment of ice dagger 26 is illustrated in FIG. 7, in which tube 12 is fully enclosed but communicates through opening 31 and handle 27, thereby permitting fractured ice to pass through tube 12 without generating substantial back pressures. An internal relief 32 internal of tube 12 may also be provided to reduce back pressures.

Figure 8:
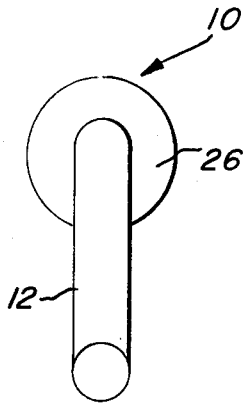
FIGS. 8 through 10 are simplified, frontal views of varying configurations of cylindrical cross section ice anchoring devices.
Figure 9:
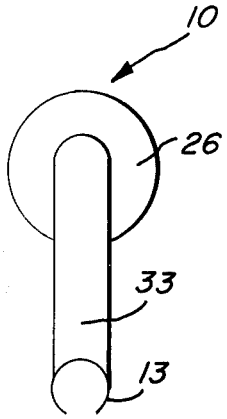
Figure 10:
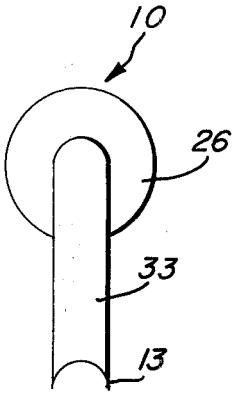

The above discussion has been primarily concerned with the preferred embodiment in which a tube 12 constitutes the impacting portion of anchoring device 10. However, as shown in FIGS. 9 through 15, anchoring device 10 is, broadly speaking, an elongated member 33 having defined internally thereof a channel with at least a portion thereof having opposing walls. Thus, the simplified embodiment of anchoring device 10 shown in FIG. 8 functions as described in some detail above. Similarly, it will be recognized that the embodiments of FIGS. 9 and 10 in which elongated members 33 are not closed at cutting edge 13 would similarly afford favorable results. Thus, as long as, with reference to the basic cylindrical section, no less than a semi-cylinder is employed as elongated member 33, useful results are obtainable.

Figure 11:
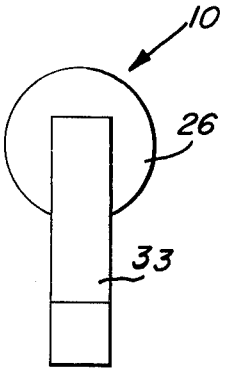
FIGS. 11 through 13 are views similar to that of FIGS. 8 through 10 in which the ice anchoring device utilizes a rectangular cross section.
Figure 12:
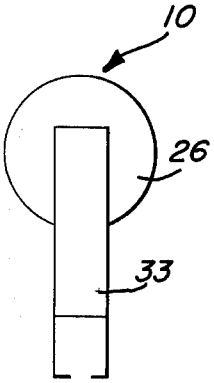
Figure 13:
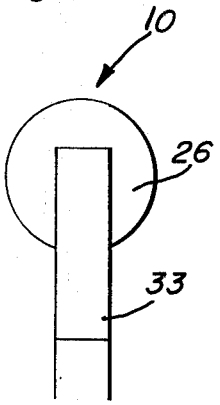
Figure 14:
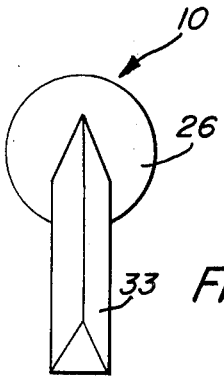
FIGS. 14 and 15 are views similar to FIGS. 8 through 13 in which the ice anchoring device employs a triangular cross section.
Figure 15:
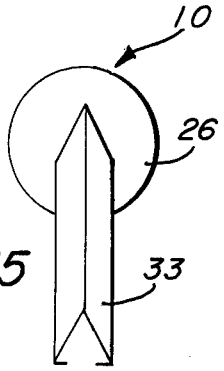

With regard to FIGS. 11, 12 and 13, a rectangular cross section of elongated member 33 again is entirely functional as long as at least a portion of the channel defined in elongated member 33 includes opposed walls. Various other cross sectional configurations such as the triangular cross section shown in FIGS. 14 and 15 would also provide the advantages of the instant invention, i.e., crushing the ice internally between opposed walls of a channeled elongated member while allowing the ice immediately external of the walls to be substantially undisturbed to provide great anchoring strength for anchoring device 10.

Though not critical for all conditions, it has been found that the cross sectional area of the channel relative to the cross sectional area of the wall defining the channel of elongated member 33 should be of a rational of at least 1.9 to 1.0 of the pentrating tip. Preferably, within the bounds of reasonable strength and other such practical considerations, elongated member 33 should have the greatest channel area relative to the most limited wall area.

Summarily, the instant invention recognizes a unique means of implanting an ice hammer in ice. This means involves an elongated member having a channel defined therethrough. Preferably, the outer walls of the elongated member are parallel, or substantially parallel. The elongated member may be of various cross sectional configurations provided at least a portion of the channel has opposed side walls. A cutting edge is provided at the end of the channel with an inwardly directed bevel from the cutting edge through the thickness of the side walls. Accordingly, when driven into ice, substantial inward forces are generated to fracture the ice internally of the elongated member and within the channel, while leaving substantially undisturbed the ice external of the elongated member. Thus, the elongated member is secured in substantially undisturbed ice with innate great strength of ice.

The ice anchor has been described with particular reference to ice hammers and ice daggers, but it will of course be apparent to those skilled in the art that it would also serve as a piton or other such anchoring device. Various improvements, i.e., an opening in the channel in the case of a fully enclosed channel spaced back from the cutting edge provides for removal of the fractured ice from the channel to avoid back pressure, may be included. Towards the same end, it is sometimes desirable to somewhat enlarge the cross section of the channel immediately rearward of the cutting edge to relieve pressures on the fractured ice contained within the channel. Also, ribs or a screw design may be provided on the exterior surface of the anchoring device to aid in securing the device.

Although only limited embodiments of the present invention have been illustrated and described, it is anticipated that various changes and modifications will be apparent to those skilled in the art, and that such changes may be made without departing from the scope of the invention as defined by the following claims.

What is claimed is:

1. An ice anchoring device comprising: an elongated member having an at least partially enclosed channel defined therein, the channel being defined with at least two directly opposed walls, the exterior of the member having substantially parallel surfaces in the longitudinal direction, a bevel surface extending substantially inwardly from the exterior of the elongated member at an end thereof to the channel, and a handle connected to the elongated member; whereby, the elongated member may be driven into ice with the bevel surface defining a cutting edge to inwardly fracture the ice between the opposed portions of the channel with the fractured ice being removed through the channel, and the exterior surfaces of the elongated member being thus secured in substantially undisturbed, strong ice.

2. An ice anchoring device as set forth in claim 1 in which the channel is of an enlarged cross section at a position spaced from but adjacent to the bevel, whereby fractured ice contained in the channel is permitted to move more freely through the enlarged section of the channel.

3. An ice anchoring device as set forth in claim 1 in which the elongated member is in the form of a tubular member having at an end thereof a cutting edge adjacent the outer surface of the tubular member and the inwardly extending bevel is defined from the cutting edge to the interior surface of the tube.

4. An ice anchoring device as set forth in claim 3 in which a relief opening is defined in the wall of the tube adjacent to but spaced from the cutting edge.

5. An ice anchoring device as set forth in claim 3 in which a relief opening is defined in the wall of the tube adjacent to but spaced from the cutting edge, and the opening has defined on the edges thereof a plurality of teeth adapted to engage material in which the ice anchoring device is embedded.

6. An ice anchoring device as set forth in claim 1 in which a hammer handle depends from the handle whereby the handle functions as a hammer head.

7. An ice anchoring device as set forth in claim 6 in which the elongated member and hammer handle are disposed at an angle less than 90°.

8. An ice anchoring device as set forth in claim 6 in which the elongated member is positioned in a bore defined in the handle and of a dimension to accommodate the outer surface of the elongated member, the handle further including releasable securing means for securing the elongated member in the handle.

9. An ice anchoring device as set forth in claim 6 in which the elongated member is in the form of a tubular member having a cutting edge defined at the end thereof spaced from the handle, the cutting edge including the bevel extending inwardly to the channel.

10. An ice anchoring device as set forth in claim 9 in which a relief opening is defined in the tube wall and spaced from the cutting edge.

11. An ice anchoring device as set forth in claim 10 in which teeth are defined in the defining edge of the relief opening.

12. An ice anchoring device comprising:

a hammer handle, an elongated member having an at least partially enclosed channel defined therein and substantially parallel exterior walls in the elongated direction, the channel having at least in part directly opposed walls, a cutting edge defined at an end of the elongated member and sloping inwardly towards the channel and means connecting the hammer handle to the elongated member.

13. An ice anchoring device as set forth in claim 12 in which the connecting means is a hammer head and the elongated member is a tubular member with the cutting edge defined by the intersection of an inwardly sloping bevel and the outer surface of the tubular member.

14. An ice anchoring device as set forth in claim 13 in which the tubular member has defined therein a relief opening spaced from but adjacent to the cutting edge, and the tubular member and hammer handle define an angle of less than 90°.

15. A method for establishing an anchor in ice comprising:

driving an elongated member having substantially parallel exterior surfaces in the elongated direction, a channel defined therein and a cutting edge defined at an end thereof into ice;

generating compressive forces in the ice at the cutting edge and within the channel;

fracturing the ice by means of the compressive forces to create an opening in the ice;

freely moving the exterior surfaces of elongated member into the opening created by fracturing the ice while carrying the fractured ice away from the opening through the channel and;

removing the fractured ice from the elongated member through a relief opening defined in the elongated member adjacent to but spaced from the cutting edge;

whereby an opening to secure an anchoring device may be created in ice without substantially weakening the ice defining the opening.

* * * * *